US010684059B2

(12) United States Patent
Tao et al.

(10) Patent No.: US 10,684,059 B2
(45) Date of Patent: Jun. 16, 2020

(54) REFRIGERATOR AND CONTROL METHOD THEREOF

(71) Applicants: QINGDAO HAIER SPECIAL REFRIGERATOR CO., LTD., Qingdao, Shandong Province (CN); QINGDAO HAIER JOINT STOCK CO., LTD., Qingdao, Shandong Province (CN)

(72) Inventors: Haibo Tao, Qingdao (CN); Shengyuan Nie, Qingdao (CN); Ke Wang, Qingdao (CN); Jianru Liu, Qingdao (CN)

(73) Assignees: QINGDAO HAIER SPECIAL REFRIGERATOR CO., LTD., Qingdao, Shandong Province (CN); QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 283 days.

(21) Appl. No.: 15/547,804

(22) PCT Filed: Jun. 17, 2016

(86) PCT No.: PCT/CN2016/086187
§ 371 (c)(1),
(2) Date: Jul. 31, 2017

(87) PCT Pub. No.: WO2017/032151
PCT Pub. Date: Mar. 2, 2017

(65) Prior Publication Data

US 2018/0031300 A1 Feb. 1, 2018

(30) Foreign Application Priority Data

Aug. 26, 2015 (CN) ..... 2015 1 0531619

(51) Int. Cl.
*F25D 17/04* (2006.01)
*F25D 17/06* (2006.01)

(52) U.S. Cl.
CPC ..... *F25D 17/065* (2013.01); *F25D 17/045* (2013.01); *F25D 2317/067* (2013.01); *F25D 2317/0665* (2013.01); *F25D 2400/28* (2013.01)

(58) Field of Classification Search
CPC ..... F25D 17/06; F25D 17/04; F25D 17/065; F25D 17/045; F25D 11/02; F25D 17/042;
(Continued)

(56) References Cited

U.S. PATENT DOCUMENTS 5,368,072 A * 11/1994 Cote ..... F16K 11/0655 137/872
9,341,402 B1 * 5/2016 Loudermilk ..... F25C 5/182
2003/0024254 A1 * 2/2003 Yoshida ..... F25D 17/042 62/78

FOREIGN PATENT DOCUMENTS

CN 1470829 A 1/2004
CN 1475734 A 2/2004
(Continued)

*Primary Examiner* — Vivek K Shirsat
*Assistant Examiner* — Ko-Wei Lin
(74) *Attorney, Agent, or Firm* — Cheng-Ju Chiang

(57) ABSTRACT

The present invention relates to a refrigerator and a control method thereof. The present invention provides a refrigerator, comprising: a storage compartment; a refrigeration air passage configured to supply refrigeration air and comprising one or more refrigeration air outlets connected with the storage compartment such that a part or all of the refrigeration air in the refrigeration air passage is blown to the storage compartment via the one or more refrigeration air outlets; and a local air passage configured to receive refrigeration air from the refrigeration air passage and blow the received refrigeration air to a local area of the storage
(Continued)

compartment in a concentrated manner. In addition, this invention also provides a control method of a refrigerator.

5 Claims, 4 Drawing Sheets

(58) Field of Classification Search
CPC .. F25D 17/062; F25D 17/067; F25D 2317/06; F25D 2317/063; F25D 2317/066; F25D 2317/0664; F25D 2317/0665; F25D 2317/0666; F25D 2317/0667
USPC ..... 62/441, 447
See application file for complete search history.

(56) References Cited

FOREIGN PATENT DOCUMENTS

| | | | | | |
|---|---|---|---|---|---|
| CN | 1880893 | A | * | 12/2006 | |
| CN | 201170681 | Y | | 12/2008 | |
| CN | 201203316 | Y | | 3/2009 | |
| CN | 105066554 | A | | 11/2015 | |
| CN | 105066563 | A | | 11/2015 | |
| CN | 204923641 | U | | 12/2015 | |
| CN | 205002481 | U | | 1/2016 | |
| JP | 2013204891 | A | * | 10/2013 | ..... F25D 17/045 |

* cited by examiner

REFRIGERATOR AND CONTROL METHOD THEREOF

CROSS REFERENCE TO RELATED APPLICATIONS

The present application is a 35 U.S.C. § 371 National Phase conversion of International (PCT) Patent Application No. PCT/CN2016/086187, filed on Jun. 17, 2016, which claims benefit of Chinese patent application 201510531619.X filed on Aug. 26, 2015, the disclosure of which is incorporated by reference herein. The PCT International Patent Application was filed and published in Chinese.

TECHNICAL FIELD

The present invention is related to the field of freezing and refrigeration technologies, and more particularly, to a refrigerator.

BACKGROUND

Air-cooled refrigerators can maintain the freshness of food, extend food storage time and improve food safety, so they become essential home appliances. However, in current air-cooled refrigerators, usually the air supply passage is arranged at the rear part of a storage compartment. After cooled air is blown, it sinks. As a result, the temperature at the front part of the storage compartment is relatively high, while the temperature at the rear part thereof is relatively low, causing uneven temperatures. The front part of the storage compartment is close to the door and heat leak can easily occur. Accordingly, the temperature at the front part of the storage compartment will be even higher, which is unfavorable for storing food. In particular, for articles requiring quick refrigeration, such as beverages or water melons just bought, existing refrigerators need a long time to allow these articles to reach a user-desired temperature, so that users cannot enjoy these articles in time.

SUMMARY

A first aspect of this invention aims to overcome at least one defect of existing refrigerators, and provides a novel refrigerator. The refrigerator can quickly cool some articles put therein and quickly allow them to reach a user-desired temperature.

An object of a second aspect of this invention is to provide a control method of a refrigerator.

According to the first aspect of the present invention, there is provided a refrigerator, comprising: a storage compartment; a refrigeration air passage configured to supply refrigeration air and comprising one or more refrigeration air outlets connected with the storage compartment such that a part or all of the refrigeration air in the refrigeration air passage is blown to the storage compartment via the one or more refrigeration air outlets; and a local air passage configured to receive refrigeration air from the refrigeration air passage and blow the received refrigeration air to a local area of the storage compartment in a concentrated manner.

Optionally, the refrigerator further comprises an air passage switching device configured to controllably close or open an air path between an air inlet of the refrigeration air passage and the local air passage and an air path between the air inlet of the refrigeration air passage and the one or more refrigeration air outlets, such that when the air path between the air inlet of the refrigeration air passage and the one or more refrigeration air outlets is closed, all the refrigeration air entering the refrigeration air passage is supplied to the local area via the local air passage.

Optionally, the refrigerator further comprises a cooling chamber provided with an air outlet connected with the refrigeration air passage; a cooling device provided in the cooling chamber to cool the air passing the cooling chamber; a blower provided at the air outlet of the cooling chamber; and a return air passage connecting a lower space of the storage compartment and the cooling chamber, such that a part or all of the air in the storage compartment enters the cooling chamber via the return air passage and enters the refrigeration air passage after being cooled by the cooling device.

Optionally, the refrigerator further comprises another storage compartment; another refrigeration air passage connecting the air outlet of the cooling chamber and the another storage compartment; and another return air passage connecting the another storage compartment and the cooling chamber, wherein the air passage switching device is further configured to controllably close or open the another refrigeration air passage.

Optionally, the refrigeration air passage comprises a general refrigeration air passage and connects a first branch between the general refrigeration air passage and the one or more refrigeration air outlets and a second branch between the general refrigeration air passage and the local air passage.

Optionally, the air passage switching device comprises: a movable air supply hood provided at an outer side of the air outlet of the cooling chamber and configured to provide an opening allowing refrigeration air to flow into the refrigeration air passage when closing the air outlet of the cooling chamber; a first air door configured to controllably close or open the general refrigeration air passage; and a second air door configured to controllably open the second branch when closing the first branch and open the first branch when closing the second branch.

Optionally, the local air passage comprises: a top air passage provided at a top wall of the storage compartment and connected with the refrigeration air passage to receive refrigeration air therefrom; and an air guiding pipe comprising an air inlet end connected with the top air passage and an air outlet end for supplying air to the storage compartment, wherein the air guiding pipe is bent downwards to the air outlet end after horizontally extending for a predetermined length from the air inlet end to form an air outlet opening downwards, such that the refrigeration air flowing into the top air passage from the refrigeration air passage is blown downwards in a concentrated manner to the local area of the storage compartment under the air inlet of the air guiding pipe via the air guiding pipe.

Optionally, the refrigerator further comprises an air supply device configured to cause air flow to enter the air guiding pipe via the top air passage.

According to the second aspect of the present invention, there is provided a control method of a refrigerator, the refrigerator comprising: a storage compartment, a local air passage and a refrigeration air passage, wherein the refrigeration air passage is configured to supply refrigeration air to the storage compartment and the local air passage, and the local air passage is configured to blow the received refrigeration air to a local area of the storage compartment in a concentrated manner. In particular, the method comprises: an instruction receiving step of receiving a local area quick refrigeration instruction; and an action performing step of closing an air path between an air inlet of the refrigeration air passage and one or more refrigeration air outlets of the refrigeration air passage connected to the storage compartment, and opening an air path between the air inlet of the refrigeration air passage and the local air passage, such that all the refrigeration air entering the refrigeration air passage is supplied to the local area of the storage compartment via the local air passage.

Optionally, the action performing step further comprises: closing another refrigeration air passage between the air inlet of the cooling chamber of the refrigerator and another storage compartment of the refrigerator, opening a general refrigeration air passage of the refrigeration air passage and opening an air supply device of the refrigerator.

Using the refrigerator and the control method thereof of this invention, as the refrigerator includes a local air passage, refrigeration air from the refrigeration air passage can be blown to the local area of the storage compartment, the local area of the storage compartment can be cooled quickly, and the articles put therein can be cooled quickly.

Further, using the refrigerator and the control method thereof of this invention, as the refrigerator includes an air passage switching device, all the refrigeration output in the refrigerator can be blown to a certain area in a concentrated manner, so that food placed in that area such as beverages, water, meat or the like can be cooled quickly, achieving good preservation and freshness-retaining effects for food and meeting users' demand for prompt use.

The above and other objects, advantages and features of the invention will be understood by those skilled in the art more clearly with reference to the detailed description of the embodiments of this invention below with reference to the accompanying drawings.

BRIEF DESCRIPTION OF THE DRAWINGS

The followings will describe some embodiments of this invention in detail in an exemplary rather than restrictive manner with reference to the accompanying drawings. The same reference signs in the drawings represent the same or similar parts. Those skilled in the art shall understand that these drawings are only schematic ones of this invention, and may not be necessarily drawn according to the scales. In the drawings.

DETAILED DESCRIPTION

Figure 1:
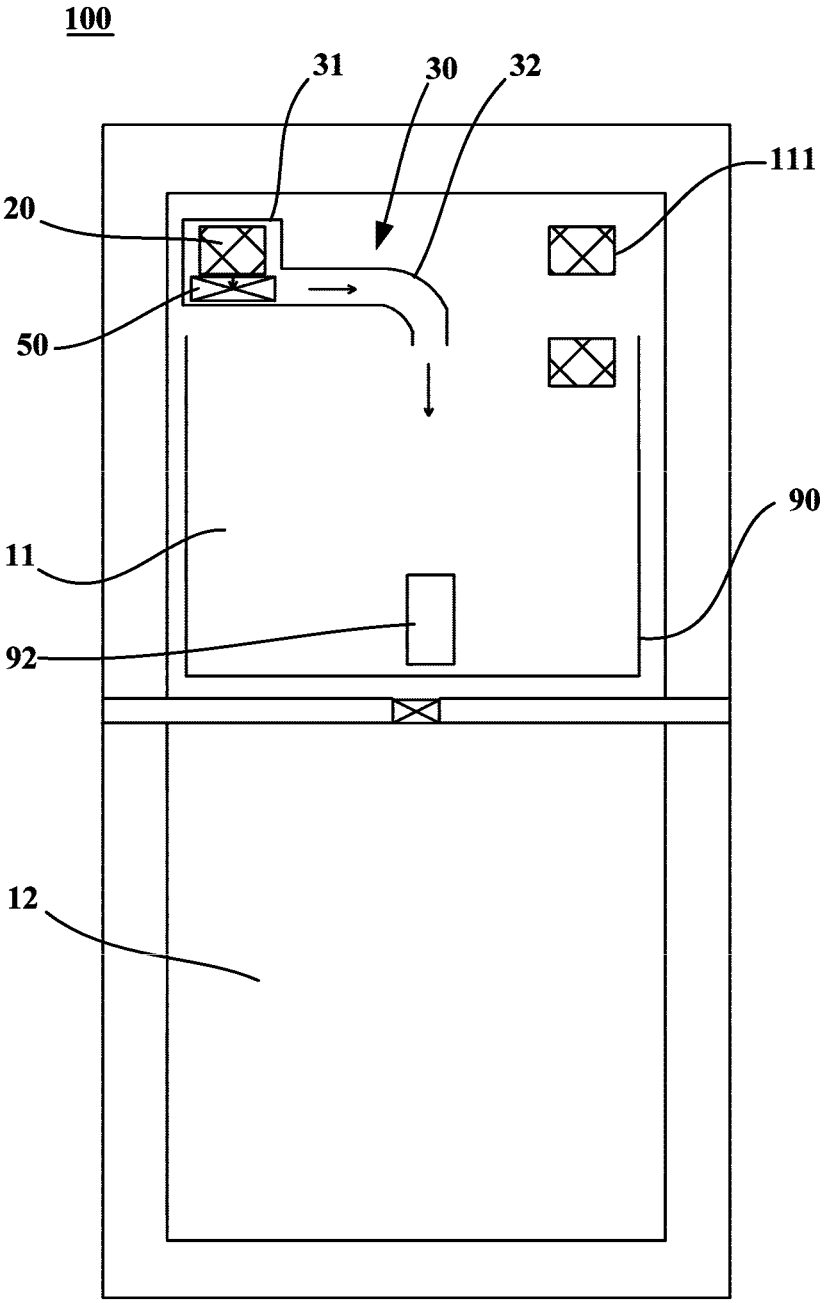
FIG. 1 is a schematic front view of a refrigerator according to an embodiment of this invention.

FIG. 1 is a schematic front view of a refrigerator 100 according to an embodiment of this invention. As shown in FIG. 1, the embodiment of this invention provides a refrigerator 100. The refrigerator 100 may typically comprise a storage compartment 11 for storing food, a refrigeration air passage 20 for providing and/or supplying refrigeration air to the storage compartment 11, and a door 14 for closing the storage compartment 11. The refrigeration air passage 20 may comprise one or more refrigeration air outlets 111 directly connected with the storage compartment 11 such that a part or all of the refrigeration air in the refrigeration air passage is blown to the storage compartment via the one or more refrigeration air outlets 111. In particular, the refrigerator 100 may further comprise a local air passage 30 configured to receive refrigeration air from the refrigeration air passage 20 and blow the received refrigeration air to a local area of the storage compartment 11 in a concentrated manner, so that the articles 92 placed in that local area of the storage compartment 11 can be cooled quickly, achieving good freshness-retaining effect and meeting users' demand for use.

In some embodiments of this invention, the local air passage 30 may comprise a top air passage 31 and an air guiding pipe 32. The top air passage 31 may be provided at a top wall of the storage compartment 11 and connected with the refrigeration air passage 20 to receive refrigeration air therefrom. The air guiding pipe 32 comprises an air inlet end connected with the top air passage 31 and an air outlet end for supplying air to the storage compartment 11. Preferably, the air guiding pipe 32 is bent downwards to the air outlet end after horizontally extending for a predetermined length from the air inlet end to form an air outlet opening downwards, such that the refrigeration air flowing into the top air passage 31 from the refrigeration air passage 20 is blown downwards in a concentrated manner to the local area of the storage compartment 11 under the air inlet of the air guiding pipe 32 via the air guiding pipe 32. In some alternative embodiments of this invention, the local air passage 30 may be realized by other air passages, such as a side air passage installed at a side wall of the refrigerator 100 for blowing the refrigeration air from the refrigeration air passage 20 to the local area of the storage compartment 11 in a concentrated manner.

To improve the air supply efficiency or the quick refrigeration efficiency, the refrigerator in the embodiments of this invention may further comprise an air supply device 50 configured to cause air flow to enter the air guiding pipe 32 via the top air passage 31, so that the refrigeration air flowing into the top air passage 31 from the refrigeration air passage 20 is blown downwards in a concentrated manner via the air guiding pipe 32, and the articles 92 in the area under the air outlet of the air guiding pipe 32 are cooled quickly.

In further embodiments of this invention, the air guiding pipe 32 comprises an air inlet end connected with the air outlet of the top air passage 31, and the air supply device 50 is provided inside the top air passage 31 and/or the air guiding pipe 32. For example, the air supply device 50 may be realized as a centrifugal impeller or an axial fan provided at the air outlet of the top air passage 31. In even further embodiments of this invention, the air inlet of the air supply device 50 communicates with and is connected to the air outlet of the top air passage 31, and the air outlet of the air supply device 50 communicates with and is connected to the air inlet of the air guiding pipe 32. For example, the air supply device 50 may be a centrifugal fan.

Figure 2:
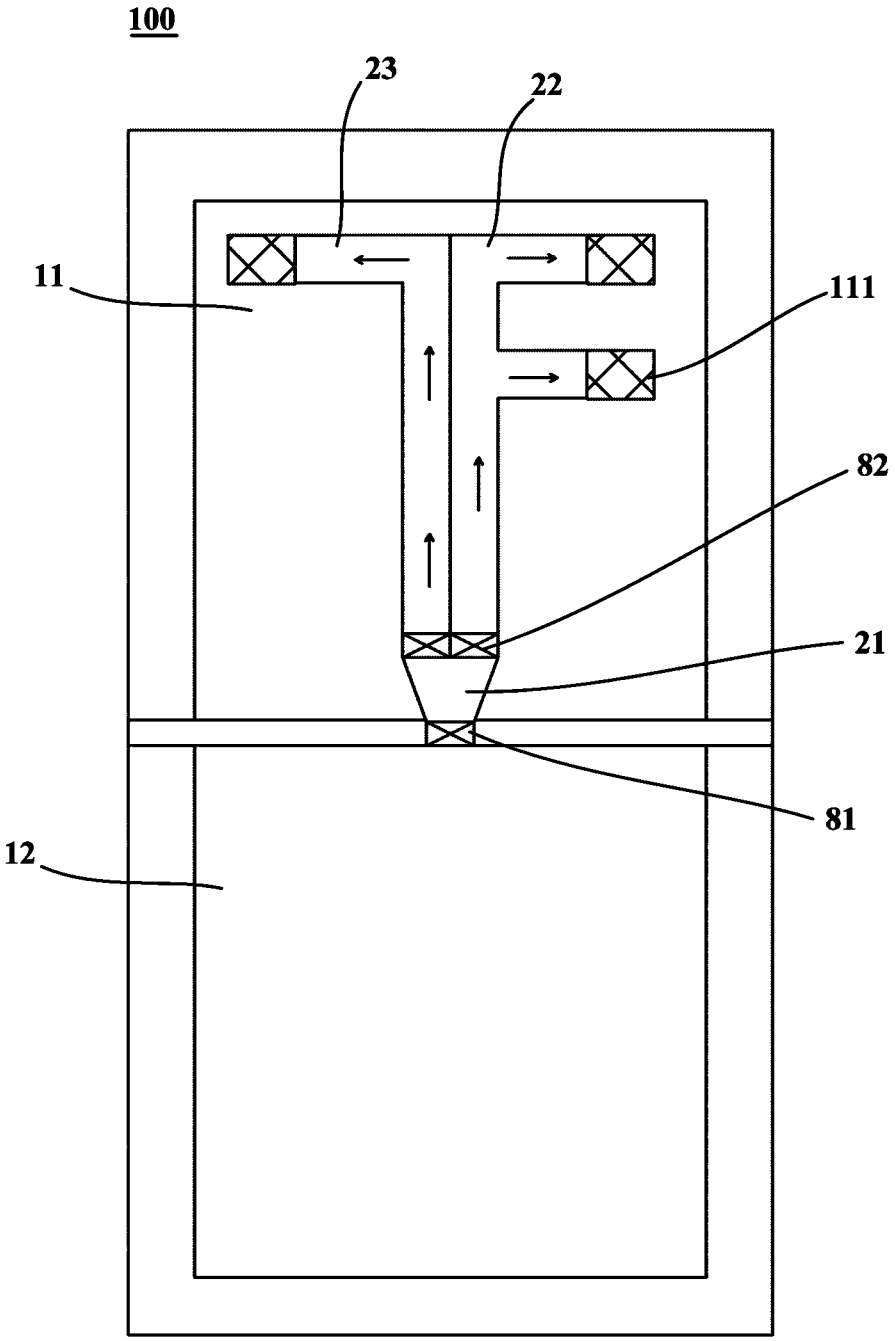
FIG. 2 is a schematic local view of a refrigerator according to an embodiment of this invention.

In some embodiments of this invention, as shown in FIG. 2, the refrigeration air passage 20 may be arranged at a rear wall of the storage compartment 11. The refrigeration air passage 20 may comprise a general refrigeration air passage 21 and connects a first branch 22 between the general refrigeration air passage 21 and the one or more refrigeration air outlets 111 and a second branch 23 between the general refrigeration air passage 21 and the local air passage 30.

Figure 3:
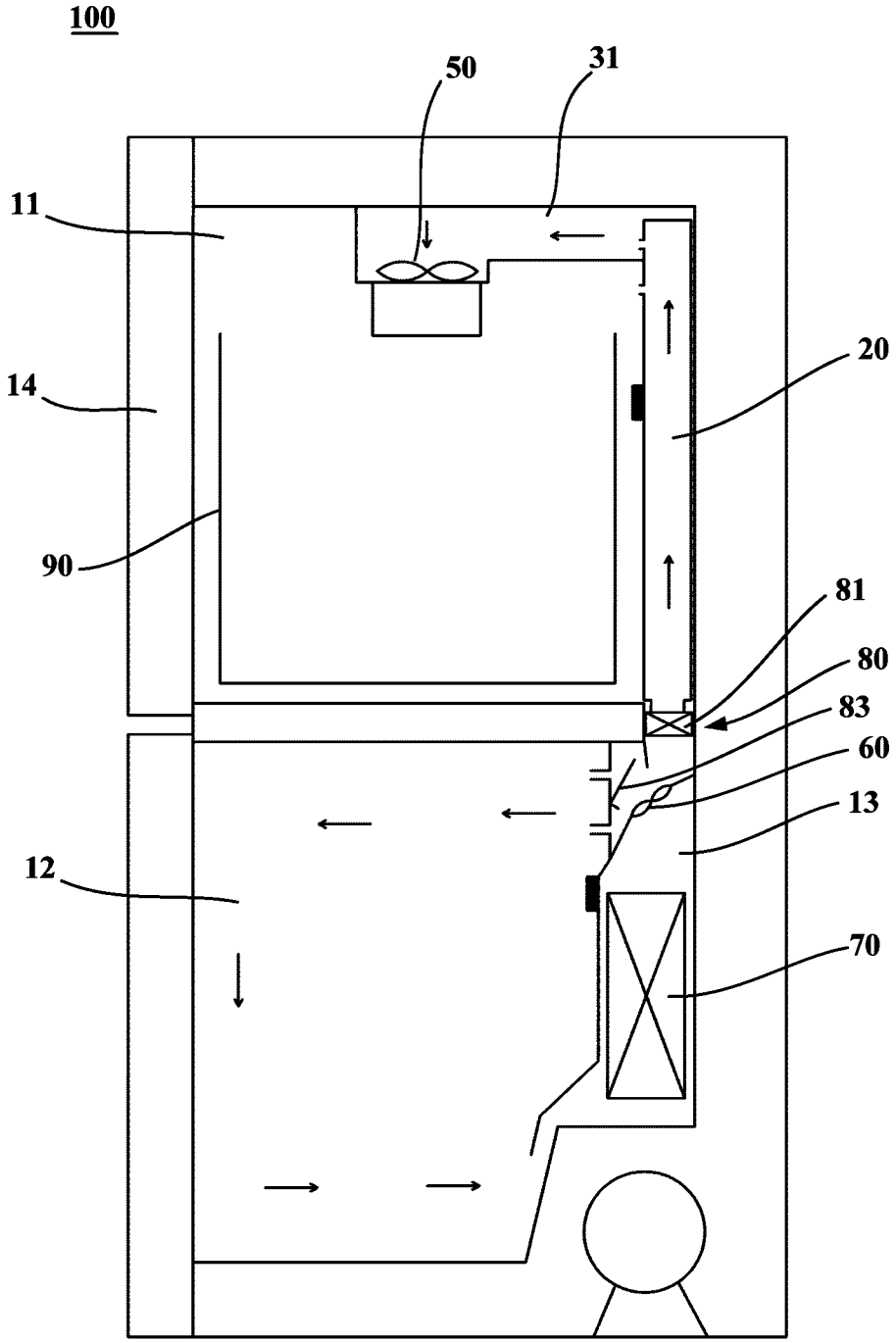
FIG. 3 is a schematic left view of a refrigerator according to an embodiment of this invention.

Further, as shown in FIG. 3, the top air passage 31 may extend longitudinally. A rear end face of the top air passage 31 may be provided with an air inlet connected with the refrigeration air passage 20, and a front end face thereof may be provided with an air outlet for supplying air to the air guiding pipe 32. For example, the refrigerator 100 may comprise a top air passage cover plate mounted at an inner surface of the top wall of the storage compartment 11 to form the top air passage 31. The top air passage cover plate may comprise a cover plate portion and a projecting web portion projecting downwards and located at the front end of the cover plate portion, and the air supply device 50 may be provided inside the projecting web portion. To reasonably arrange the space inside the storage compartment 11, the top air passage 31 may be arranged in a corner at the top of the storage compartment 11, which extends longitudinally.

Further, as shown in FIG. 1, the horizontal portion of the air guiding pipe 32 may extend transversely. An air outlet of the air guiding pipe 32 faces a vertical downside direction, and may be provided at the transverse center of the storage compartment 11, so that the user can conveniently place articles requiring quick refrigeration. In this embodiment, the air supply device 50 is a centrifugal fan or a centrifugal impeller, and is configured to suck refrigeration air flowing into the top air passage 31 from the top of the top air passage and horizontally blow at least part of the refrigeration air to the air guiding pipe 32.

In some preferred embodiments of this invention, the refrigerator may further comprise an air passage switching device 80 configured to controllably close or open an air path between an air inlet of the refrigeration air passage 20 and the local air passage 30 and an air path between the air inlet of the refrigeration air passage 20 and the one or more refrigeration air outlets 111, such that when the air path between the air inlet of the refrigeration air passage 20 and the one or more refrigeration air outlets 111 is closed, all the refrigeration air entering the refrigeration air passage 20 is supplied to the local area via the local air passage 30.

For example, in some embodiments, the air passage switching device 80 comprises: a first air door 81 configured to controllably close or open the general refrigeration air passage 21; and a second air door 82 configured to controllably open the second branch 23 when closing the first branch 22 and open the first branch 22 when closing the second branch 23. Specifically, the first air door 81 may be arranged at the air inlet of the general refrigeration air passage 21 to control the opening and closing of the general refrigeration air passage 21. The second air door 82 may be arranged at the air inlet of the first and second branches 22, 23 to close the second branch 23 when opening the first branch 22 and close the first branch 22 when opening the second branch 23. When supplying air in a concentrated manner, the air supply device 50, the first air door 81 and the second air door 82 may be started/opened at the same time, so that all the refrigeration air is blown downwards from the air outlet of the air guiding pipe 32. In some alternative embodiments, the air passage switching device 80 may comprise two independently working doors arranged at the respective air inlets of the first and second branches 22, 23.

In some embodiments of this invention, the refrigerator 100 may further comprise a cooling chamber 13, a blower 60, a cooling device 70 and a return air passage. The cooling chamber 13 is provided with an air outlet connected with the refrigeration air passage 20. Specifically, the air outlet of the cooling chamber 13 may be connected with the general refrigeration air passage 21. The cooling device 70 may be an evaporator of a compression refrigeration system, and may be arranged inside the cooling chamber 13 to cool the air passing the cooling chamber. The return air passage connects a lower space of the storage compartment 11 and the cooling chamber 13. The blower 60 may be arranged at the air inlet of the cooling chamber 13, and may be configured such that a part or all of the air in the storage compartment 11 enters the cooling chamber 13 via the return air passage and enters the refrigeration air passage 20 after being cooled by the cooling device 70. That is, the blower 60 provides power for the part or all of the air in the storage compartment 11 of the refrigerator 100 such that the part or all of the air flows out of the storage compartment 11 and enters the refrigeration air passage 20 after being cooled.

In some embodiments of this invention, to facilitate picking and placing of articles, the refrigerator 100 may further comprise a drawer 90 for receiving the articles 92, such as beef, water melons and beverages. The drawer 90 can be operably inserted into the storage compartment 11 and pulled out of the same. In other words, the drawer 90 is installed inside the storage compartment 11. Optionally, a lower part of the rear wall of the drawer 90 comprises ventilation holes, so that the air flow flowing out of the air outlet of the air guiding pipe 32 can easily flow out of the drawer 90 via the ventilation holes of the drawer 90 after exchanging heat with the articles inside the drawer 90, and enter the return air passage for circulation.

In some embodiments of this invention, as shown in FIG. 3, the refrigerator 100 may further comprise another storage compartment 12, which may be arranged blow the storage compartment 11. For example, the storage compartment 11 may be a refrigeration compartment, and the another storage compartment 12 may be a freezing compartment. Further, a quick freezing compartment may be provided between the storage compartment 11 and the another storage compartment 12. The cooling chamber 13 in the embodiments of this invention may be arranged behind the another storage compartment 12.

In the embodiments of this invention, the refrigerator 100 further comprises another refrigeration air passage connecting the air outlet of the cooling chamber 13 and the another storage compartment 12, and another return air passage connecting the another storage compartment 12 and the cooling chamber 13. The air passage switching device 80 is further configured to controllably close or open the another refrigeration air passage, so that during quick refrigeration, all the refrigeration air flows out of the air outlet of the air guiding pipe 32. Specifically, the air passage switching device 80 may further comprise a movable air supply hood 83 provided at an outer side of the air outlet of the cooling chamber 13 and configured to provide an opening allowing refrigeration air to flow into the refrigeration air passage 20 when closing the air outlet of the cooling chamber 13. That is, when the movable air supply hood 83 closes the air outlet of the cooling chamber 13, the another refrigeration air passage connected with the another storage compartment 12 can be closed, so that the refrigeration air passage 20 is not blocked.

The refrigerator 100 of the embodiments of this invention may have multiple working modes. As shown in FIGS. 1-3, the arrows in the figures represent the flow directions of air flow. The multiple working modes may comprise the following working modes: an independent working mode of the storage compartment 11, an independent working mode of the another storage compartment 12, a joint working mode and an accurate refrigeration mode. In the independent working mode of the storage compartment 11, the movable air supply hood 83 is closed, the first air door 81 is opened, the second air door 82 is connected with the first branch 22, the blower 60 works while the air supply device 50 does not work, so that the storage compartment 11 works independently. In the independent working mode of the another storage compartment 12, the movable air supply hood 83 is opened, the first air door 81 is closed, the blower 60 works while the air supply device 50 does not work, so that the another storage compartment 12 works independently. In the joint working mode, the movable air supply hood 83 is opened, the first air door 81 is opened, the second air door 82 is connected with the first branch 22, the blower 60 works while the air supply device 50 does not work, so that the two storage compartments 11, 12 work jointly. In the accurate refrigeration mode, the movable air supply hood 83 is closed, the first air door 81 is opened, the second air door 82 is connected with the second branch 23, and both the blower 60 and the air supply device 50 work, so that accurate refrigeration can be performed in a certain area of the storage compartment 11. To prevent excessive temperature rise in other areas of the storage compartment 11 and in the another storage compartment 12, after the accurate refrigeration mode operates for a certain period, the refrigerator automatically exits from this mode.

Figure 4:
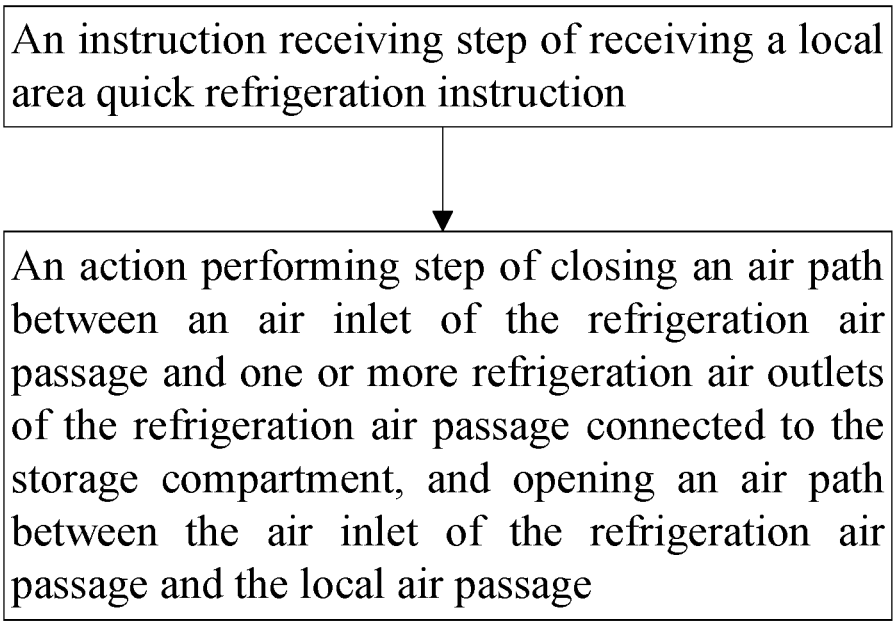
FIG. 4 is a schematic flow chart showing a control method of a refrigerator according to an embodiment of this invention.

FIG. 4 is a schematic flow chart showing a control method of a refrigerator according to an embodiment of this invention. As shown in FIG. 4, an embodiment of this invention further provides a control method of a refrigerator, the refrigerator comprising: a storage compartment, a local air passage and a refrigeration air passage, wherein the refrigeration air passage is configured to supply refrigeration air to the storage compartment and the local air passage, and the local air passage is configured to blow the received refrigeration air to a local area of the storage compartment in a concentrated manner. The method comprises an instruction receiving step of receiving a local area quick refrigeration instruction. When a user puts an article requiring quick refrigeration, such as a bottle of Coca Cola, in the storage compartment of the refrigerator, the user may press a quick refrigeration key/a touch key, so that the refrigerator receives a local area quick refrigeration instruction. The method further comprises an action performing step of closing an air path between an air inlet of the refrigeration air passage and one or more refrigeration air outlets of the refrigeration air passage connected to the storage compartment, and opening an air path between the air inlet of the refrigeration air passage and the local air passage, such that all the refrigeration air entering the refrigeration air passage is supplied to the local area of the storage compartment via the local air passage, and the article in the local area can be cooled quickly.

In further embodiments of this invention, the action performing step may further comprise closing another refrigeration air passage connecting the air inlet of the cooling chamber of the refrigerator and another storage compartment of the refrigerator, opening a general refrigeration air passage of the refrigeration air passage and opening an air supply device of the refrigerator, so that all the refrigeration air in the refrigerator is used for quick refrigeration. To prevent excessive temperature rise in other areas of the storage compartment and in the another storage compartment, the method may further comprise: after a predetermined period passes, closing an air path between the air inlet of the refrigeration air passage and the local air passage so that the refrigerator enters other working modes. The control method of the embodiments of this invention may also be applied to the accurate refrigeration mode of refrigerators.

Although multiple embodiments of this invention have been illustrated and described in detail, those skilled in the art may make various modifications and variations to the invention based on the content disclosed by this invention or the content derived therefrom without departing from the spirit and scope of the invention. Thus, the scope of this invention should be understood and deemed to include these and other modifications and variations.

What is claimed is:

1. A refrigerator, comprising:

a storage compartment;

a refrigeration air passage configured to supply refrigeration air and comprising:

a general refrigeration air passage;

one or more refrigeration air outlets connected with the storage compartment such that a part or all of the refrigeration air in the general refrigeration air passage is blown to the storage compartment via the one or more refrigeration air outlets;

a first branch between the general refrigeration air passage and the one or more refrigeration air outlets; and a second branch;

a local air passage configured to receive refrigeration air from the general refrigeration air passage via the second branch and blow the received refrigeration air to a local area of the storage compartment;

a centrifugal impeller or an axial fan or a centrifugal fan configured in the local air passage;

a cooling chamber provided with an air outlet connected with the refrigeration air passage;

a blower configured to cause air flow enter the general refrigeration air passage from the cooling chamber;

one or more second air doors configured to controllably close or open an air path between an air inlet of the general refrigeration air passage and the local air passage and an air path between the air inlet of the general refrigeration air passage and the one or more refrigeration air outlets, such that when the air path between the air inlet of the general refrigeration air passage and the one or more refrigeration air outlets is closed, all the refrigeration air entering the general refrigeration air passage is supplied to the local area via the local air passage;

a cooling device provided in the cooling chamber to cool the air passing the cooling chamber, wherein the air enters the general refrigeration air passage after being cooled by the cooling device; and a blower provided at the air outlet of the cooling chamber;

another storage compartment;

another refrigeration air passage connecting the air outlet of the cooling chamber and the another storage compartment;

another return air passage connecting the another storage compartment and the cooling chamber;

a movable air supply hood configured to controllably close or open the another refrigeration air passage.

2. The refrigerator of claim 1, further comprising:

a first air door configured to controllably close or open the general refrigeration air passage;

the one or more second air doors configured to controllably open the second branch when closing the first branch and open the first branch when closing the second branch; and the movable air supply hood provided at an outer side of the air outlet of the cooling chamber and configured to provide an opening allowing refrigeration air to flow into the refrigeration air passage when closing the air outlet of the cooling chamber.

3. The refrigerator of claim 1, wherein the local air passage comprises:

a top air passage provided at a top wall of the storage compartment and connected with the refrigeration air passage to receive refrigeration air therefrom; and an air guiding pipe comprising an air inlet end connected with the top air passage and an air outlet end for supplying air to the storage compartment, wherein the air guiding pipe is bent downwards to the air outlet end after horizontally extending for a predetermined length from the air inlet end to form an air outlet opening downwards, such that the refrigeration air flowing into the top air passage from the refrigeration air passage is blown downwards to the local area of the storage compartment under the air inlet of the air guiding pipe via the air guiding pipe.

4. The refrigerator of claim 3, wherein the centrifugal impeller or the axial fan or the centrifugal fan is configured to cause air flow to enter the air guiding pipe via the top air passage.

5. The refrigerator of claim 3, wherein the top air passage extends longitudinally forward, and a rear end of the top air passage is provided with an air inlet connected with the second branch, and a front end of the top air passage is provided with an air outlet for supplying air to the air guiding pipe; the horizontal portion of the air guiding pipe extends transversely from the air outlet of the top air passage.

* * * * *